US006247451B1

(12) United States Patent
Estevenon et al.

(10) Patent No.: US 6,247,451 B1
(45) Date of Patent: Jun. 19, 2001

(54) INTERNAL COMBUSTION ENGINE MULTIPOINT INJECTION MODULE

(75) Inventors: Christine Estevenon, Osny; Henri Trintignac, Paris Cedex, both of (FR)

(73) Assignee: Sagem S.A., Paris (FR)

( * ) Notice: Subject to any disclaimer, the term of this patent is extended or adjusted under 35 U.S.C. 154(b) by 0 days.

(21) Appl. No.: 09/403,415

(22) PCT Filed: Feb. 24, 1999

(86) PCT No.: PCT/FR99/00412

§ 371 Date: Dec. 13, 1999

§ 102(e) Date: Dec. 13, 1999

(87) PCT Pub. No.: WO99/43940

PCT Pub. Date: Sep. 2, 1999

(30) Foreign Application Priority Data

Feb. 26, 1998 (FR) ..... 98 02345

(51) Int. Cl.[7] ..... F02M 41/00; F02M 51/00

(52) U.S. Cl. ..... 123/456; 123/478; 123/490; 73/119 A

(58) Field of Search ..... 123/456, 486, 123/490, 478; 701/104; 73/119 A

(56) References Cited

U.S. PATENT DOCUMENTS

| | | | | |
|---|---|---|---|---|
| 4,402,294 | * | 9/1983 | McHugh et al. | 123/480 |
| 5,157,967 | * | 10/1992 | Wieczorek | 73/119 A |
| 5,295,627 | * | 3/1994 | Wahba | 239/585.4 |
| 5,663,881 | * | 9/1997 | Cook, Jr. | 123/456 |
| 5,839,420 | * | 11/1998 | Thomas | 123/478 |
| 5,920,004 | * | 7/1999 | Gottshall et al. | 123/480 |

* cited by examiner

*Primary Examiner*—Thomas N. Moulis
(74) *Attorney, Agent, or Firm*—Larson & Taylor PLC

(57) ABSTRACT

The invention concerns an injection module comprising a ramp (10) to be connected to a supply pump and several injectors (12) connected to the ramp each provided with electric control means for opening and closing them. The module comprises means for storing a calibrating function of each of the injectors (12) and supply the function in a form that can be used by a computing unit (24) controlling the electric means for opening and closing the injectors.

9 Claims, 2 Drawing Sheets

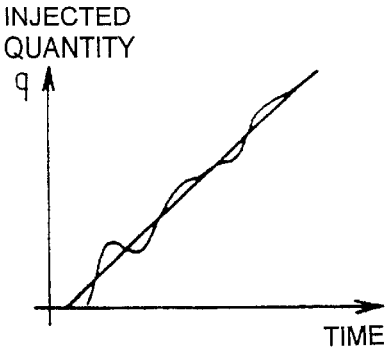
FIG.1.
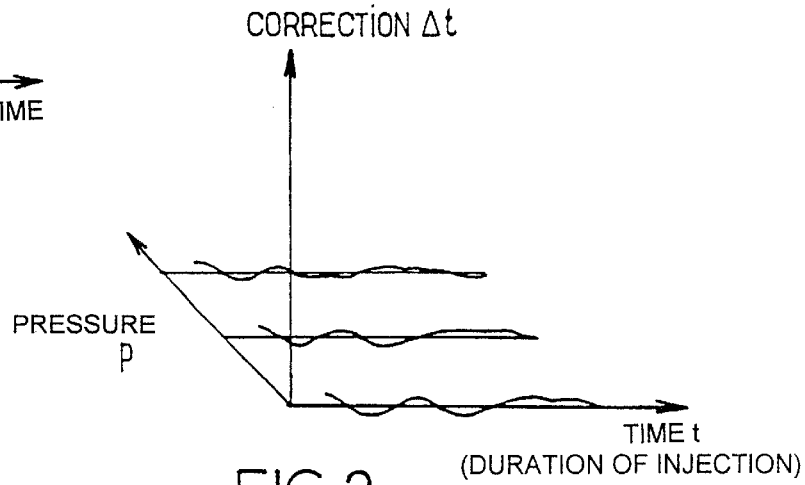
FIG.2.
FIG.3.
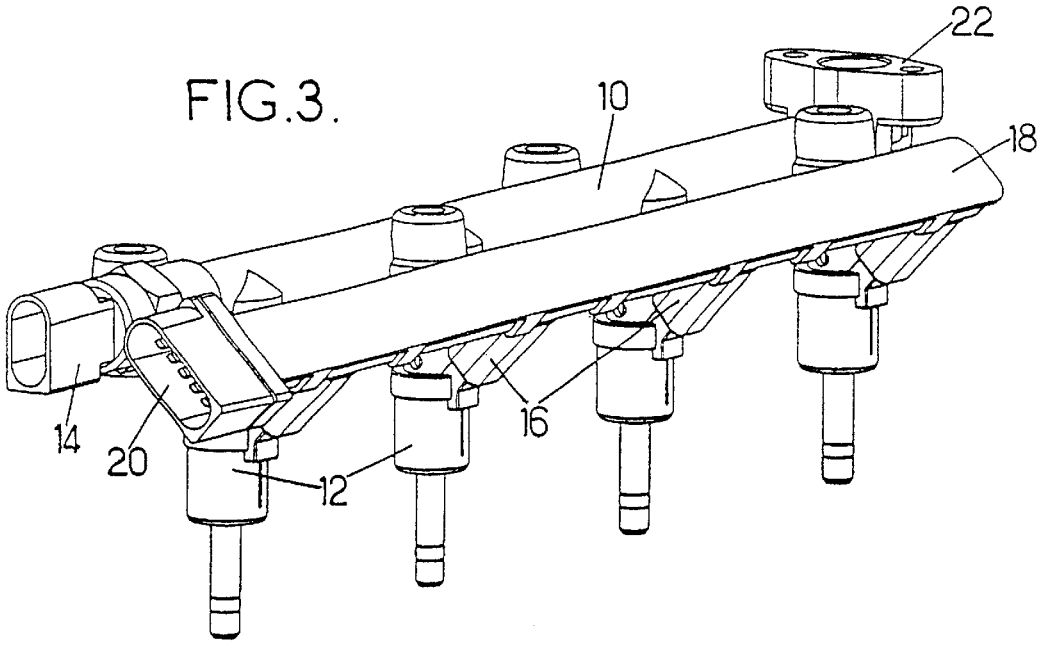

INTERNAL COMBUSTION ENGINE MULTIPOINT INJECTION MODULE

BACKGROUND OF THE INVENTION

The invention relates to electronically controlled multipoint injection devices for an internal combustion engine and more specifically an injection module belonging to such a device and comprising a rail, designed to be connected to a supply pump, and several injectors connected to the rail, each being provided with electrical control means for opening and closing it.

The injectors are manufactured to an indicated or set characteristic, which, desirably, is linear. The bold line of FIG. 1 shows an indicated characteristic which can be regarded as being typical. The quantity injected, at a constant pressure differential between the supply and the combustion chamber is essentially a linear function of the opening time. In practice, manufacturing tolerances cause variations, particularly if the injection duration is short. The curve denoted by the fine line in FIG. 1 illustrates an example of a real characteristic. In order to be acceptable, the injectors must have a characteristic whereby the variance relative to the reference characteristic does not exceed a given percentage, for example +/−5%. In order to comply with this condition, each injector manufactured is put through bench tests, during which an attempt is made by trial and error to prestress the closing spring, so that the injector is set as closely as possible to the reference characteristic. These are lengthy operations and in addition allow only limited variances to be compensated since they involve acting on the characteristic in a global manner.

U.S. Pat. No. 5,575,264 describes a first attempt to overcome the problem associated with dispersions of the characteristics. For that, an EEPROM from which the technical data of the injector can be read is attached to each injector.

An object of the present invention is to provide an injection module that will allow relatively large variations in the injector characteristics to be tolerated.

To this end, the invention proposes in particular an injection module comprising means for storing a calibration function of each of the injectors and for supplying said function in a format that can be used by a computing unit controlling the electrically controlled opening duration of the injectors.

The function to be stored is automatically determined by plotting the injected quantities for a given number of given opening durations distributed over the dynamic operating range. This function can then be stored in the form of a polynomial of a sufficient order or in map form.

Currently, fuel is injected into a chamber at a differential pressure which varies as a function of the operating parameters of the engine. This situation may be taken into account by using a dual-input map model (duration of injection and differential pressure) or by using a polynomial with two variables. In view of the fact that calibration can be performed automatically, the only manual operations being fitting and removal of the injector, it is possible to accept a very large number of measurement points with durations of injection which may vary within a very broad range, for example from 0.15 ms up to 10 ms. Since the main variable is the duration of injection, it will be sufficient to carry out tests for 2 or 3 different pressure differentials on an automatic test bench.

The stored model must accompany the injector and be taken into account when controlled by the computing unit.

In one advantageous embodiment, the model is stored in a read-only memory, for example, within a complete module comprising the injection rail and the injectors, which are permanently fixed to it. The module can then be provided with a connector providing a link to the computing unit and the power amplifier which is controlled by this computing unit and opens the injectors. The connector is provided with a contact or contacts, allowing representative models of the correction relative to the indicated characteristic to be copied with a view to loading the model into the computing unit. The latter can then be programmed to take account of the corrections on each indicated duration of actuation, so as to take account of the actual characteristic of each injector.

Generally speaking, the module will also have a pressure sensor supplying an electric output signal representative of the injection pressure prevailing in the rail. The computing unit is connected to this sensor as well as to a sensor giving the pressure at the inlet of the combustion chambers, representative of the pressure prevailing in these chambers during injection. The computing unit can then take account not only of the model representative of the real characteristic as a function of the indicated duration of injection but also the corrections to be applied as a function of the differential injection pressure. The pressure sensors will generally be piezo-resistive sensors, which have the requisite robustness for a long service life under the operating conditions of an internal combustion engine. The features outlined above as well as various others will become clearer from the description of a specific embodiment of the invention given below by way of example but which is not restrictive in any respect. The description is given with reference to the appended drawings.

BRIEF DESCRIPTION OF THE DRAWINGS

FIG. 1, mentioned above, shows an example of the variation in the quantity of fuel injected as a function of the duration of injection;

FIG. 2 illustrates an example of a correction $\Delta t$ to be applied to the duration of injection as a function of the injection time, for several pressure differentials p;

FIG. 3 is a perspective view of a module enabling the invention to be implemented.

DETAILED DESCRIPTION

Figure 4:
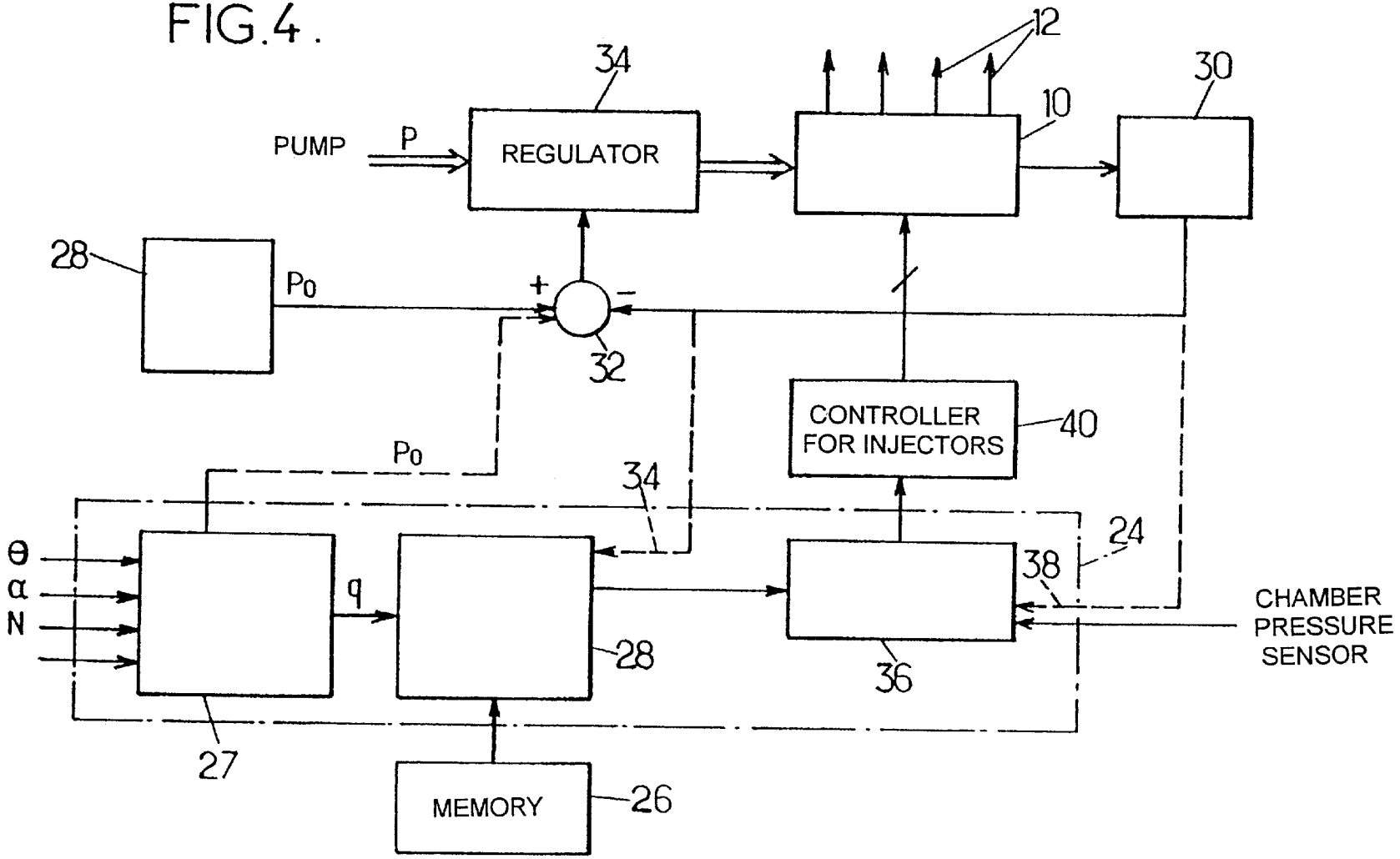
FIG. 4 is a synoptic diagram showing the hardware and software components involved in implementation.

As mentioned above, several calibration functions can be automatically determined on a test bench for several different values of pressure differential p. FIG. 2 illustrates three functions corresponding to three different pressure differential values. These calibration functions may be stored in digital form in several different ways. A first solution consists in sampling each of the curves, optionally after smoothing, and storing the points sampled for each of the three differential pressures. This produces a map memory. It may be used either by applying a correction corresponding to the closest point stored or by bilinear interpolation. However, the complexity of this latter solution detracts from its appeal since the corrections applied are still very slight. The curves may also be stored in the form of a polynomial with two variables, which will give better continuity than a map memory, or several polynomial representations as a function of time corresponding to several differential pressures.

Irrespective of what the function is, it is stored in a memory which will accompany an injection module. The module schematically illustrated in FIG. 3 has an injection rail 10 to which four electrically controlled injectors 12 are connected. The rail is provided with a fuel delivery connector 14, connected to a high pressure pump, optionally via a regulator. Each injector is provided with an electrical connector 16 to provide a link to conductors contained in a block 18 provided with an electric terminal connector 20.

The module has a non-volatile memory in which the calibration function is loaded. In general, this memory will be a memory which can be accessed for read out from a contact of the connector 20. However, it is possible to provide a memory which can be written to with a view to re-calibration after a period of use of the module. The contents of the module memory are set up so that they can be transferred into the memory of an engine control computer at the end of the integration line of the vehicle. In one embodiment, the module may simply be accompanied by a memory whose contents are transferred to the computer at the end of the integration line.

If the calibration function takes account of the differential pressure, the module will be complemented by a pressure sensor, for example a piezoelectric sensor, which can be connected to a socket fitting 22. A second sensor (not illustrated) is then provided as a means of determining the pressure in the combustion chambers.

The essential components involved in implementing the invention are shown in FIG. 4. The functions denoted inside dotted-dashed lines s24 will generally be performed by the engine control computer, to which the function stored in the memory 26 accompanying the module is transferred. The computer 24 may be deemed to have a block 27 for managing the supply of fuel to the engine, to which the operating parameters, such as the position $\alpha$ of the accelerator pedal, speed N, temperature $\theta$, etc . . . are applied. On the basis of these elements, the block 27 is capable in particular of working out a fuel reference pressure P0 (broken-line arrow in FIG. 4). However, this reference pressure P0 may just as easily be worked out by a separate element 28, depending on the pressure in the combustion chambers at the onset of exhaust, for example. The pressure in the rail 10 is measured by a sensor 30. An error term is computed in an adder 32 and supplied to a regulator 34 supplying the rail 12.

The block 27 supplies a reference q for the quantity to be injected to a correction block 28 into which the calibration function, which may be the real law of variation q(t) or a combination of the nominal law q=At (t being a constant) and the correction law $\Delta t$ (t), is loaded. The block 28 illustrated receives an output signal from the sensor 30 on an input 34. The correction as a function of the pressure may be applied in this block or in an additional block 36, which receives the output of a pressure sensor in the combustion chambers. The pressure in the rail may be applied to an input 38 in situations where corrections as a function of duration and as a function of differential pressure are applied in a cascaded manner.

The corrected duration signal is applied to a power circuit 40 controlling the injectors 12.

What is claimed is:

1. A fuel injection module for an electronically controlled multipoint injection device for an internal combustion engine, comprising:

a rail arranged to be connected to a supply pump, a plurality of injectors connected to the rail and each provided with electrical means for controlling opening and closing of said injector, means for storing a calibration function of each of the injectors and supplying the function in a form suitable for use by a computing unit controlling an electrical signal determining a duration of opening of each of said injectors, said means for storing consisting of a single memory common to all said injectors and containing the calibration functions of all said injectors, and a single common electrical connector for connection of the module to said computing unit, communicating said common storage means with the computing unit, and for connection of said electrical means to a power circuit for delivering said electrical signals.

2. A module according to claim 1, wherein said function is stored in polynomial or map form.

3. A module according to claim 1, wherein said calibration function is a function delivering a correction responsive to the duration of injection only.

4. A module according to claim 1, wherein said calibration function depends on the duration of injection and a pressure differential between the rail and the engine combustion chambers.

5. A module according to claim 1, wherein said module further has a pressure sensor arranged to supply an electric output signal representative of a pressure of the fuel in the rail and means for connecting said pressure sensor to the computing unit.

6. A module according to claim 5, wherein said means for storage comprise a non-volatile memory in which the calibration function is stored in a form which can be loaded into the computing unit through the connector of said module.

7. A fuel injection module for an electronically controlled multipoint injection device of an internal combustion engine, comprising:

a rail arranged to be connected to a fuel supply pump, a plurality of injectors securely connected to the rail for constituting a unitary assembly and each provided with electrical means for controlling opening and closing of said injector, common storage means for storing a calibration function of each of the injectors and supplying the function in a form suitable for use by a computing unit controlling a time duration of signals delivered by an electrical generator to said electrical means and causing opening of said injectors, and a single electrical connector for communication of said common storage means with the computing unit and of said electrical means with the electrical generator, wherein said calibration functions provide corrections to be made to said time durations responsive to at least said durations and are each specific to one of said injectors.

8. A module according to claim 7, wherein said module further has a pressure sensor arranged to supply an electric output signal representative of a pressure of the fuel in the rail and means for connecting said pressure sensor to the computing unit and said calibration function depends on the duration of injection and on a difference between the pressure in the rail as measured by said pressure sensor and a pressure in a respective combustion chamber of the engine.

9. A module according to claim 7, wherein said calibration functions depend on both the duration of injection and a pressure differential between the rail and a respective combustion chamber of the internal combustion engine.

* * * * *